US007022195B2

(12) United States Patent
Otani et al.

(10) Patent No.: US 7,022,195 B2
(45) Date of Patent: Apr. 4, 2006

(54) METHOD OF MANUFACTURING INNER BLADE FOR ELECTRIC RAZOR

(75) Inventors: Ryuji Otani, Osaka (JP); Toshio Ikuta, Hikone (JP); Takashi Kozai, Inukami-gun (JP); Hiroyuki Okada, Sakata-gun (JP); Shinji Fujimoto, Neyagawa (JP); Shigetoshi Sakon, Hirakata (JP)

(73) Assignee: Matsushita Electric Works, Ltd., Kadoma (JP)

( * ) Notice: Subject to any disclaimer, the term of this patent is extended or adjusted under 35 U.S.C. 154(b) by 305 days.

(21) Appl. No.: 10/415,104

(22) PCT Filed: Sep. 9, 2002

(86) PCT No.: PCT/JP02/09174

§ 371 (c)(1),
(2), (4) Date: Apr. 30, 2003

(87) PCT Pub. No.: WO03/022535

PCT Pub. Date: Mar. 20, 2003

(65) Prior Publication Data

US 2004/0006863 A1 Jan. 15, 2004

(30) Foreign Application Priority Data

Sep. 10, 2001 (JP) ..... 2001-273652

(51) Int. Cl.
*B26B 19/06* (2006.01)

(52) U.S. Cl. ..... 148/527; 148/588; 148/649; 72/335; 72/340; 72/341; 30/43.91; 30/43.92

(58) Field of Classification Search ..... 148/527, 148/588, 649; 72/335, 340, 341, 379.2; 30/43.91, 30/43.92

See application file for complete search history.

(56) References Cited

U.S. PATENT DOCUMENTS

| | | | | |
|---|---|---|---|---|
| 2,833,033 | A | 5/1958 | Heyek | |
| 5,214,833 | A | 6/1993 | Yada | |
| 5,316,599 | A * | 5/1994 | Ebato et al. | 148/512 |
| 5,893,211 | A * | 4/1999 | Hotani | 30/43.92 |
| 6,637,113 | B1 * | 10/2003 | Ikuta et al. | 30/43.92 |

FOREIGN PATENT DOCUMENTS

| | | |
|---|---|---|
| DE | 2 348 380 | 4/1974 |
| EP | 0 733 445 | 9/1996 |

(Continued)

*Primary Examiner*—George Wyszomierski
(74) *Attorney, Agent, or Firm*—Oblon, Spivak, McClelland, Maier, & Neustadt, P.C.

(57) ABSTRACT

An inner cutter for a dry shaver is fabricated from a metal plate to have a plurality of blades each provided with cutting edges. The metal plate includes a plurality of parallel straight slits to leave an array of straight beams each defined between the adjacent ones of the slits. The beams are forged and ground at a segment of each beam to give the cutting edges thereto. After making the cutting edges, the metal plate is bent into a generally U-shaped configuration so as to correspondingly curve the beams and shape the beams into the blades having the arcuate contour and the cutting edges. The metal plate is provided with a joint for connection with a driving source of moving the inner cutter relative to an outer cutter.

21 Claims, 10 Drawing Sheets

FOREIGN PATENT DOCUMENTS

| | | |
|---|---|---|
| GB | 2 226 972 | 7/1990 |
| JP | 58-27745 | 6/1983 |
| JP | 1-25590 | 5/1989 |
| JP | 4-176490 | 6/1992 |
| JP | 5-68754 | 3/1993 |
| JP | 5-48713 | 7/1993 |
| JP | 5-253359 | 10/1993 |
| JP | 10-277276 | 10/1998 |

* cited by examiner

METHOD OF MANUFACTURING INNER BLADE FOR ELECTRIC RAZOR

TECHNICAL FIELD

The present invention is directed to a method of fabricating an inner cutter for a dry shaver, and more particular to the inner cutter having a plurality of parallel blades of generally U-shaped configuration supported on a frame.

BACKGROUND ART

U.S. Pat. No. 5,214,833 discloses a prior inner cutter for a dry shaver. The inner cutter is punched from a single metal plate to have a plurality of blades for shearing contact with a complementary outer cutter. The blades are bent upright from the metal plate to have arcuate contours with cutting edges. For this purpose, the metal plate is firstly processed to have a plurality of arcuate slits arranged along a length of the metal plate to define, between the adjacent slits, arcuate beams which are to be later bent upward to form the blades. Notwithstanding that the blades are only required to have a thickness corresponding to the thickness of the metal plate, each blade occupy a relatively large area or dimension along the length of the metal plate before being bent upright so that the number of the blades per unit length of the metal plate is limited, resulting in waste of material. Further, since the cutting edges are formed on the blades prior to being bent upright, i.e., turned from within the plane of the metal plate, it remains a problem that even when there is a slight difference in angles of bent for some blades, the blades suffer from uneven cutting edges, which lowers the cutting efficiency of the whole inner cutter.

DISCLOSURE OF THE INVENTION

In view of the above insufficiency, the present invention has been accomplished to provide a unique method of fabricating an inner cutter for a dry shaver. The method in accordance with the present invention utilizes a flat metal plate from which a plurality of parallel blades are formed. Firstly, the metal plate is processed to form a plurality of parallel straight slits therein to leave an array of straight beams each defined between the adjacent ones of the straight slits, and to leave a frame around the array. Then, the beams are forged and ground at a portion or segment of each beam to give cutting edges extending along each one of the segments. After or before giving the cutting edges, the metal plate is bent into a generally U-shaped configuration so as to correspondingly curve the beams and shape the beams into the blades having the arcuate contour and the cutting edges. The frame is formed with a joint for connection with a driving source of moving the inner cutter relative to the outer cutter. In this manner, the blades are formed by forging and grinding the straight beams left between the adjacent one of the straight slits and by deforming the metal plate into the generally U-shaped configuration. The metal plate is only required to have a length which is substantially the sum of the widths of the straight beams and the slits, which increase the number of blades formed per unit length of the plate. Therefore, the inner cutter can be fabricated efficiently with an increased yield while reducing waste of material. Further, when formed into the U-shaped configuration, the blades are deformed simply in a direction perpendicular to the plane of the metal plate rather than being bent upright through an angle of 90°. This means that the all the blades can be oriented accurately with a simple deformation, thereby keeping the cutting edges of all the blades at a desired angle with respect to the outer cutter and therefore assuring a sharp cutting of hairs as intended.

Preferably, the cutting edges of each segment are formed through the steps of placing the metal plate between a die and a punch, and forging all the segments simultaneously by compacting the segments between the die and the punch to form on opposite sides of each segment rake faces oriented at an acute angle with respect to a plane of the metal plate, leaving a bulge on top of each segment. Then, the metal plate is ground to remove the bulges to leave on top of each segment a relief face which crosses with the rake faces at the acute angle, thereby defining the cutting edges between the rake and relief faces. With the use of the die and punch, all the blades can be simultaneously deformed to have the accurate cutting edges.

Preferably, the metal plate has a thickness of 0.05 mm or more.

Each of the segments is preferably deformed to have a rib projecting on the under surface of the segment The rib is centered with respect to the width of the segment such that the rake faces extend sideward from the upper end of the rib. With the inclusion of the rib, the rake faces can be made to cross with the top face of the segment at a small angle for realizing a sharp cutting of hairs.

In one version of the present invention, each slit is divided into at least two sub-slits arrange along the width of the metal plate and spaced by a bridge which is responsible for interconnecting the beams on opposite of each slit. Each bridge is offset along the width of the metal plate from the segments of the adjacent beams formed with the cutting edges. Each bridge is deformed to develop a recess in top of the bridge such that the recess has opposed side walls which intersect with the top face of the beam not formed with the cutting edge to define thereat auxiliary cutting edges. Thus, not only that the inner cutter can be reinforced by the bridges to keep the blades in accurate positions while and after bending the plate into the U-shaped configuration, but also that bridge can serve as auxiliary cutting elements for shaving the hairs.

The segment may be hardened after being deformed and before being grounded so as to provide the hardened cutting edges, while facilitating the plastic deformation to give the cutting edges. In this connection, the metal plate is preferably covered at a portion to be formed into the cutting edges with a hardening coat which becomes hardened by a treatment made after deforming the beams. The hardening coat is preferred to include nickel and titanium, and more particularly includes a nickel layer on the plate and a titanium layer on the nickel layer. These layers are heat-treated to diffuse the nickel and titanium atoms to give a Ni—Ti intermetallic compound therein responsible for increased hardness. The hardening coat is principally formed at such a portion of the metal plate that are deformed to provide the rake faces for keeping the desired cutting angle over a long period of use.

When the plate is bent into the generally U-shaped configuration, it is preferred to simultaneously quench the plate for keeping the blades in the intended configuration so as not to be subsequently warped.

The die, which is utilized to give the cutting edges to the segments, is preferred to include a plurality of die elements which are detachably arranged with each other to provide a plurality of concaves for receiving the segments of the metal plate when forging them in cooperation with the punch projecting towards the concaves. At least one of the concaves is defined between the adjacent ones of the die elements. After forging the segments to give the cutting edge between the die and the punch, it is firstly made to remove a limited number of the die elements away from the metal plate, and is subsequently made to remove the remainder of the die elements from the metal plate. With this technique, the forged metal plate can be easily released from the die without suffering from undue stress which would otherwise impair the finished segments and the cutting edges.

When the metal plate is processed such that at least one of the beams is formed as a long beam having a length longer than the adjacent beam, one of the two adjacent die elements responsible for forging the long beam is firstly removed from the metal plate and subsequently the other die element is removed from the metal plate. The long beam is included in the array of the beams for the purpose of generating an audible sound at a frequency reminding the user of a comfortable shaving being made. Although the long beam is more susceptible to a undesired deformation than the normal beam when the metal plate is released from the die, the above technique of removing one of the die elements responsible for forging the long beam and subsequently removing the other die element can avoid the undesired deformation that the long beam would suffer from when the both of the die elements on both sides of the long beam are simultaneously removed from the metal plate.

Also when a limited number of the beams are formed as an uninterrupted array of the long beams in the metal plate, each one of the two adjacent die elements between which each long beam is forged is firstly removed, and the other die element is subsequently removed for the same purpose as above.

The method of the present invention is preferred to utilize a holder which is capable of holding the die elements selectively in a relatively loose engagement and in a tight engagement with each other. Prior to placing the segments of the metal plate between the die and the punch, the die elements are held loosely in the holder. While forging the segments to give the cutting edges thereto, the die elements are held tightly within the holder, after which the die elements are loosened so that at least one particular die element can be readily displaced from the adjacent die element to remove the particular die element from the metal plate.

Preferably, the holder includes a frame retaining the die elements arranged side-by-side, and at least one slider attached to one end of the frame adjacent to an outermost one of the die elements. The slider is movable relative to the frame between a release position where the slider gives only a retaining force of retaining the die elements in the loose engagement with each other and a lock position where the slider gives a constraining force of holding the die elements in the tight engagement with each other. The slider is displaced from the released position to the lock position prior to forging the segment, and is kept at the lock position while forging the segments. Thereafter, the slider is displaced back to the release position, thereby eliminating the constraining force and allowing one or more of the die elements to be removed from the metal plate, selectively. With the use of the holder composed of the frame and the slider, it become easy to forge the segments accurately as well as to release the forged metal plate successfully from the die.

In order to forge the segment to have the rib projecting on the under surface thereof, the cavity formed between the two adjacent die elements is configured to have a top space, a bottom space, and an intermediate space. The top space is given a rectangular cross-section with a first width corresponding to the width of the segment after being forged. The bottom space is given a rectangular cross-section with a second width which is smaller than the first width and corresponds to a width of the rib. The intermediate space is given a tapered cross-section which communicates communicating the top space with the bottom space and has inclined bottoms on which the rake faces are formed. The metal plate is prepared to have the beams of which width is approximately equal to the first width. By designing the configuration of the cavity, it is easy to provide the rib and the rake faces on the upper end of the rib simultaneously.

Further, in order to minimize the post-forging treatment, it may be possible that the metal plate is prepared to have the beams of which thickness is approximately equal to a total depth of the cavity measured from the top of the top space to the bottom of the bottom space.

These and still other objects and advantageous features of the present invention will become more apparent from the following description of the preferred embodiments when taken in conjunction with the attached drawings.

BEST MODE FOR CARRYING OUT THE INVENTION

Figure 1:
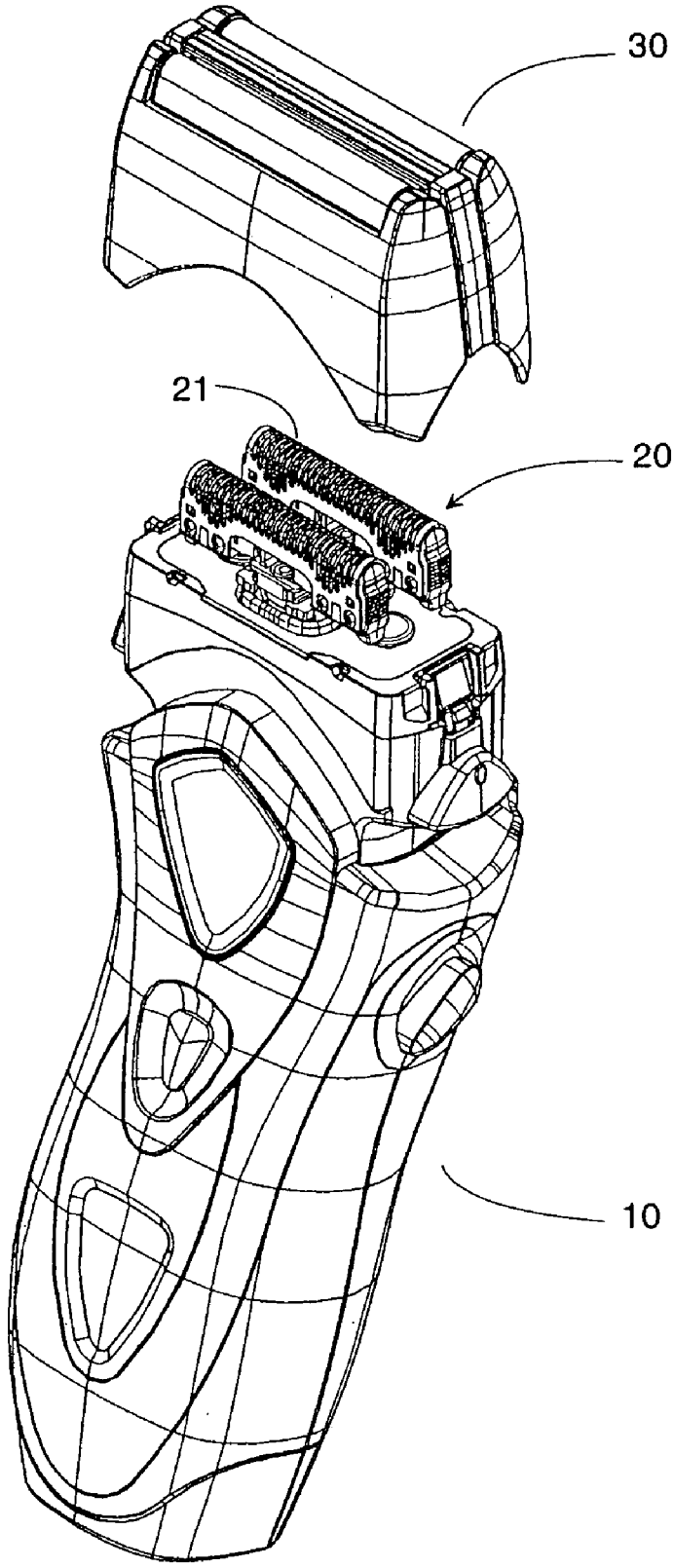
FIG. 1 is an exploded perspective view of a dry shaver having an inner cutter fabricated in accordance with a method of the present invention.
Figure 2:
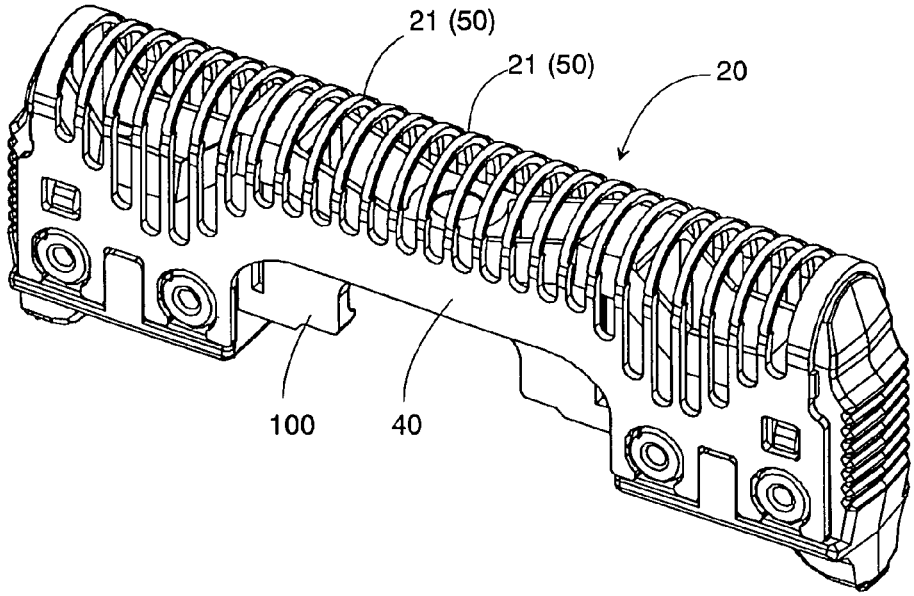
FIG. 2 is a perspective view of the inner cutter.
Figure 3:
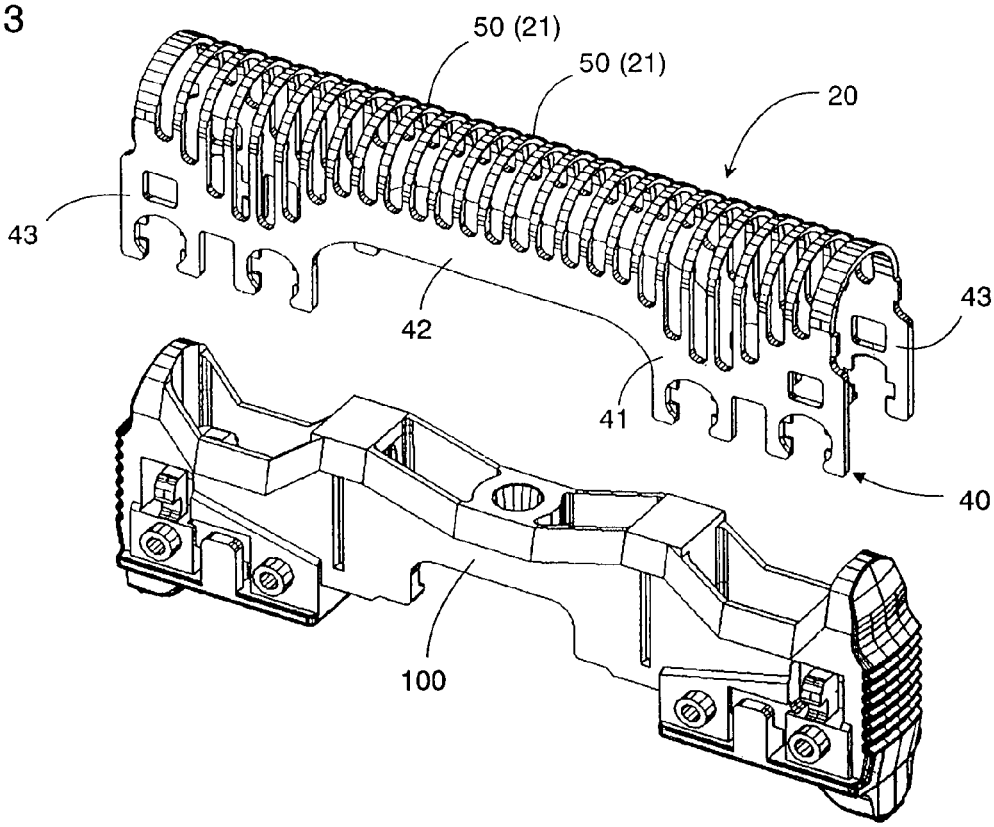
FIG. 3 is an exploded perspective view of the inner cutter.

Referring now to FIGS. 1 to 3, there is shown a dry shaver with an inner cutter 20 which is fabricated in accordance with the present invention. The inner cutter 20 has a plurality of parallel blades 21 for shearing engagement with a complementary outer cutter or foil 30 having a number of perforations responsible for introducing hairs. The inner cutter 20 is connected to a driving source incorporated in a shaver housing 10 and is driven thereby to oscillate relative to the outer cutter 30 for shearing the hairs.

As shown in FIGS. 2 and 3, the inner cutter 20 is formed from a single metal plate 40 to have a plurality of generally U-shaped blades 21 which are parallel to each other and are supported by a common frame 41. The frame 41 is secured to a joint 100 which is molded from a plastic material for connection with the driving source. The metal plate 40 is made from a martensite stainless steel into a generally rectangular configuration having a thickness of at least 0.05 mm, preferably 0.1 to 0.6 mm.

Figure 4A:
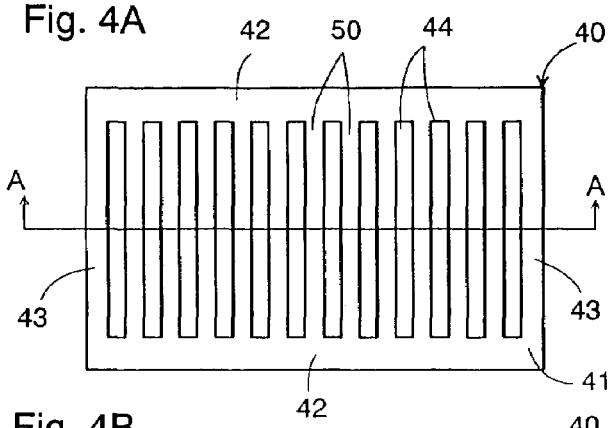
FIGS. 4A to 4D are plan views illustrating the steps of fabricating the inner cutter.
Figure 5A:
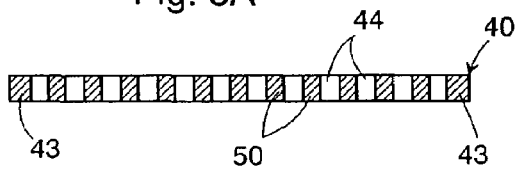
FIGS. 5A to 5F are sectional views illustrating the steps of fabricating the inner cutter.

FIGS. 4A to 4D and FIGS. 5A to 5F are provided to illustrate the steps of fabricating the inner cutter 20 from the metal plate 40. For better understanding of the features the present invention, the figures are simplified with regard to dimensions and profiles of various portions of the metal plate including those to be shaped into blades 21 of the inner cutter. Therefore, it is apparent that the present invention should not be limited to the contents of the simplified figures. As shown in FIG. 4A, the metal plate 40 is processed to form therein a plurality of straight slits 44 having a length of 7 mm to 15 mm and a width of 0.2 to 1.0 mm. The slits 44 are arranged in parallel relation with each other and at a spacing of 0.2 mm to 0.5 mm along a length of the plate 40, in order to give an array of beams 50 each defined between the adjacent ones of the slits 44, while leaving the frame 41 around the array of the beams 50. The frame 41 includes a pair of lateral brims 42 at width ends of the plate and a pair of longitudinal brims 43 at longitudinal ends of the plate 40. The beams 50 are formed in the metal plate in number of 10 to 40 with each beam dimensioned to have a length of 7 mm to 15 mm and a width of 0.2 mm to 0.5 mm. The slits may be formed by punching or etching the plate. FIG. 5A shows the metal plate in cross-section taken along line A—A of FIG. 4A.

Figure 4B:
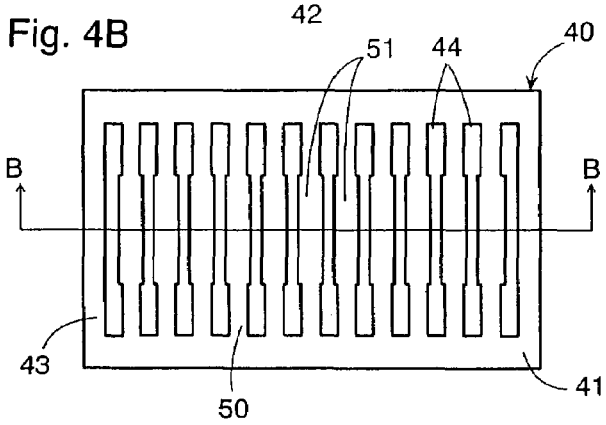
Figure 5B:
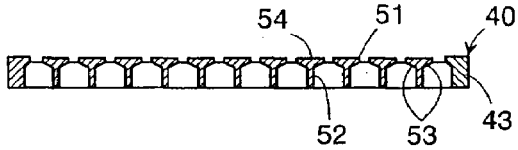
Figure 7:
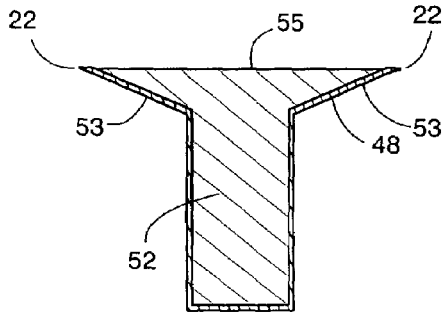
FIG. 7 is a sectional view of the blade with hardened cutting edges.
Figure 8:
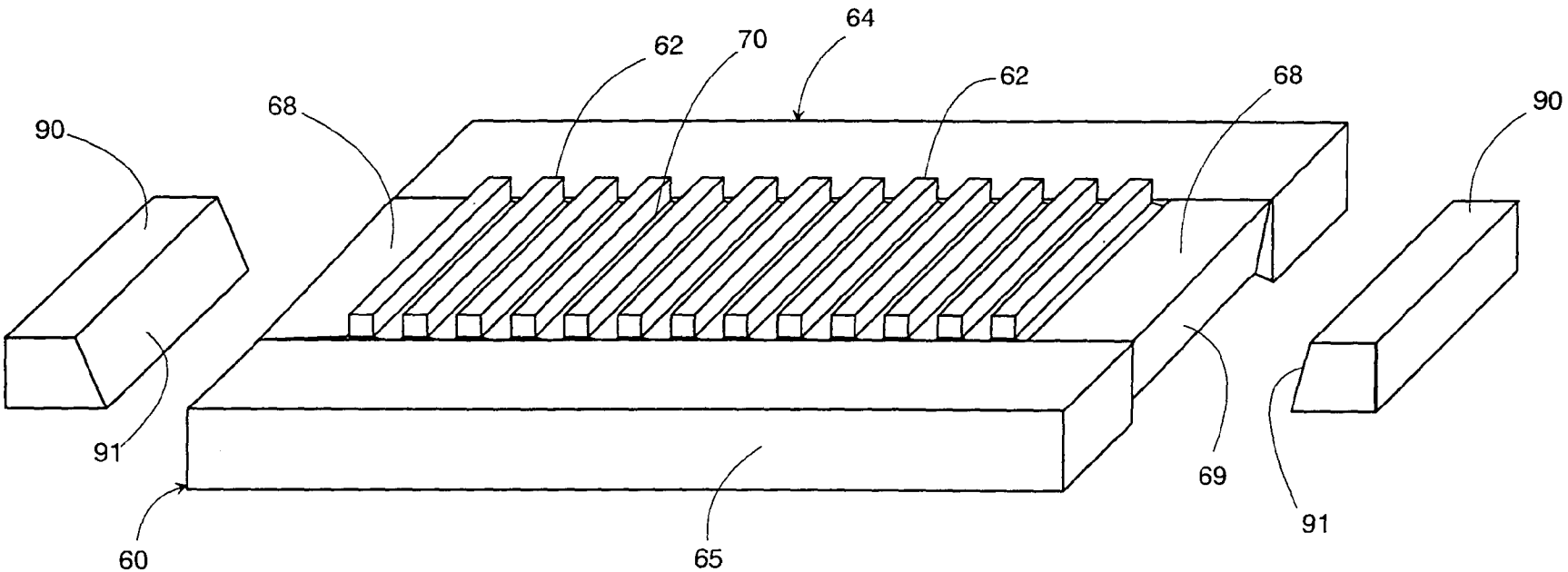
FIG. 8 is a perspective view of a die utilized for fabricating the inner cutter from a metal plate.
Figure 9A:
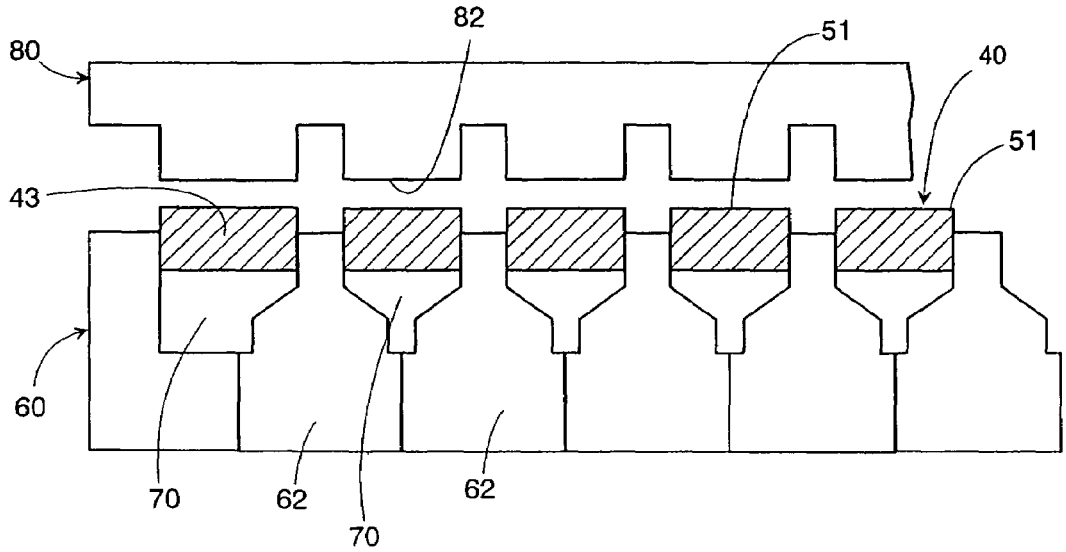
FIGS. 9A to 9C are sectional views illustrating steps of forging the metal plate with the use of the die and a punch.
Figure 9B:
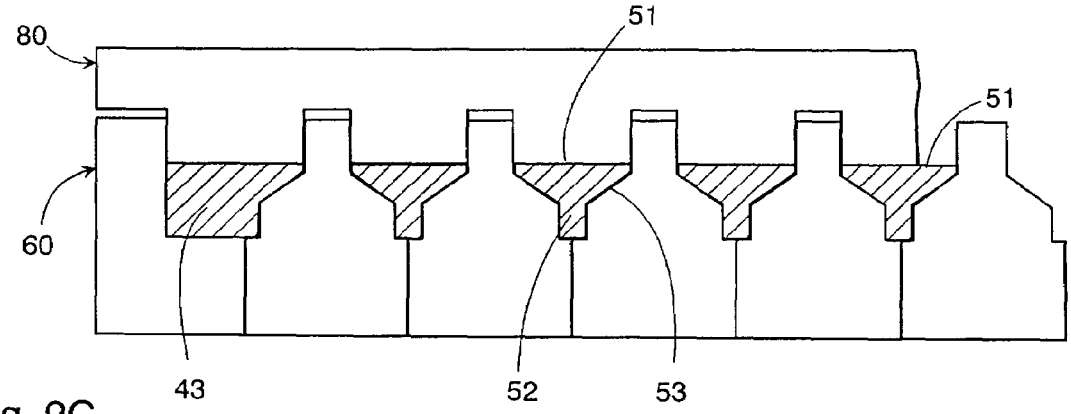

Then, as shown in FIGS. 4B and 5B which shows a cross-section taken along line B—B of FIG. 4B, the metal plate 40 is processed to forge a center segment 51 of each beam 50, i.e., over a length of 5 mm to 10 mm, so as to form on the undersurface thereof rake faces 52 which are inclined at an angle of 15 to 90°, preferably 20 to 40° with respect to a flat top plane of the plate 40. This forging process utilizes a die 60 and a punch 80, as shown in FIGS. 8 and 9. After the metal plate 40 is placed between the die 60 and 70 (FIG. 9A), the punch 80 is pressed over the center segment 51 of each beam 50 to deform it plastically or squeeze it into a cavity 70 of the die 60 (FIG. 9B), thereby forming a rib 52 as well as the rake faces 53 on the underside of the segment 31. The rake faces 53 project sideward from the upper end of the rib 52. As a consequence of forming the rib 52 and the rake faces 53, the segment 51 is formed on its top face with bulges 54 above an original top plane of the metal plate 40, as shown in FIG. 5B. It is noted in this connection, the plate 40 is formed on at least the undersurface thereof with a hardening coat 48 which are correspondingly deformed during the above process so that the rake faces 53 of each segment 51 are defined by portions of the coat, as shown in FIG. 7. As will be discussed later in the description, the hardening coats 48 become hardened by being heat-treated.

Figure 5C:
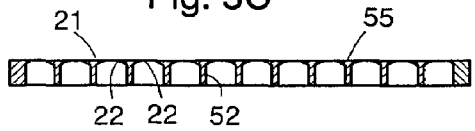

After the heat-treatment, the plate 40 is grounded to remove some portion of the top of the segment 51 including the bulges 54, providing a flat smooth relief face 55 on the segment 51 of each beam 50, as shown in FIG. 5C. Thus, the segment 51 of each beam 50 is finished to have on its opposite sides cutting edges 22 defined by the rake faces 53 and the relief face 55.

Figure 4C:
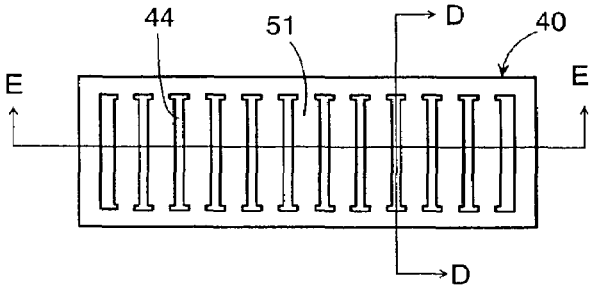
Figure 5D:
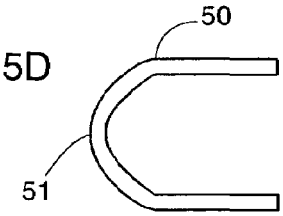
Figure 5E:
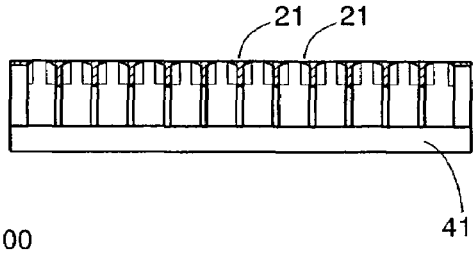
Figure 4D:
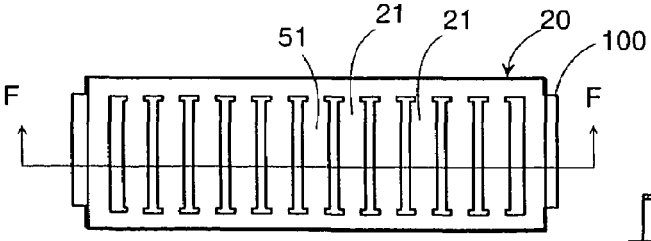
Figure 5F:
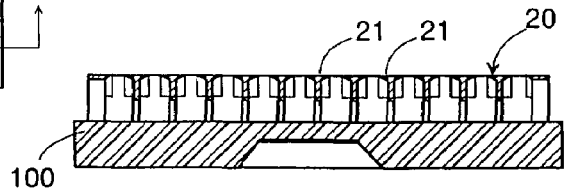
Figure 6:
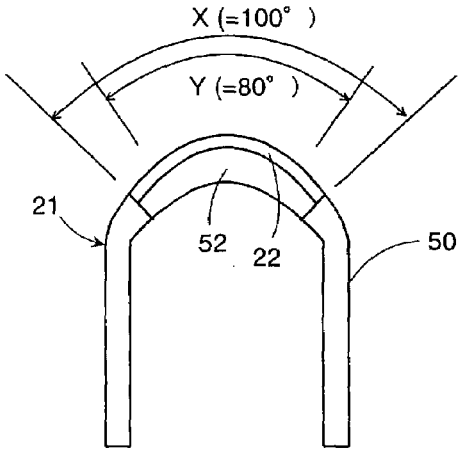
FIG. 6 is a side view of a blade of the inner cutter.

Then, the metal plate 40 is bent into the U-shaped configuration such that the segment 51 of each beam 50 is arcuately curved with the opposite ends of the beam 50 being integrally supported by the lateral brims 42 of the frame 41, as shown in FIGS. 3, 4C and 5D. FIG. 5D is a sectional view of the metal plate taken along line D—D of FIG. 4C. The segment 51 formed with the cutting edges extends over an angular range X of about 100° while the inner cutter is designed to have an effective cutting area extending over an angular range Y of about 80°, as shown in FIG. 6. When the metal plate 40 is bent into the U-shaped configuration, it is simultaneously quenched to harden and retain the bent configuration. FIG. 4C shows a top view of the metal plate thus bent into the U-shaped configuration, and FIG. 5E shows a cross-section taken along line E—E of FIG. 4C. Thereafter, the joint 100 is attached to the frame 41 as being secured between the lateral brims 42 (FIGS. 4D and 5F). Finally, the relief surfaces 55 now rounded of the segments 51 as well as the longitudinal brims 43 are polished to give a smooth contacting surface in shearing engagement with the outer cutter. At this time, the cutting edges 22 are finished to give a rounded tip having a radius of curvature R of 0.1 μm or less. Thus, the beams 50 are formed into the blades 21 having the cutting edges on opposite sides thereof for cutting the hairs in cooperation with the outer cutter. Also, the longitudinal brims 43 at the opposite ends of the plate 40 are finished to have the cutting edges respectively at their inner ends adjacent to the segments 51.

The radius of curvature R (μm) is selected in combination with the angle a (°) of the cutting edge to satisfy a following relation that $R \geqq -0.067 \cdot \alpha + 4.7$. The blades 21 with the cutting edges satisfying the above relation are found to cut the hairs effectively while avoiding the bending of the hair shafts, thereby assuring a close shaving.

Turning back to FIGS. 8 and 9, the details of the die 60 and the punch 80 are now explained. The die 60 includes a plurality of die elements 62 which are arranged side-by-side within a holder 64 to provide cavities 70 between two adjacent die elements 62. The holder 64 has a frame 65 for retaining the die elements 62 and a pair of sliders 68 closing the longitudinal ends of the frame 65. The die elements 62 are slidably supported to the frame 65 together with sliders 68 on opposite longitudinal ends of an array of the die elements 62 so that the die elements 62 can be held selectively in a tightly packed condition and in a loosely packed condition. In the tightly packed condition, i.e., a lock position, the die elements 62 are engaged tightly with each other to develop a constraining force of locking the die elements in position, such that the metal plate 40 can be forged between the die 60 and the punch 80. In a loosely packed condition, i.e., a release position, the die elements 62 are engaged relatively loosely with each other to eliminate the constraining force such that a group of some die elements 62 can be displaced relative to the adjacent die elements in a releasing direction of being released away from the metal plate 40. For this purpose, the group of the die elements 62 and the rest of the die elements are retained respectively by separate sub-holders (not shown) which are movable independently with each other in the releasing direction relative to the holder 64.

Figure 10:
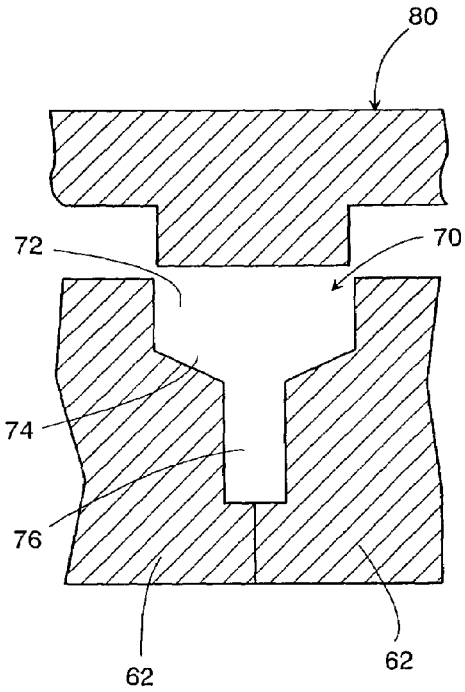
FIG. 10 is a sectional view of a portion of the die and the punch.

The die elements 62 excepts those on opposite ends of the die 60 are of an identical configuration to provide therebetween the cavities 70 of identical configuration each composed of a top space 72, a bottom space 76, and an intermediate space 74, as shown in FIG. 10. The top space 72 has a rectangular cross-section of which width corresponds to the width of segment 51 and also to each projection 82 of the punch 80. The bottom space 76 has a cross-section of which width is smaller than the width of the top space 72 and corresponds to the width of the rib 52. The intermediate space 74 has a tapered cross-section which communicates the top space 72 with the bottom space 76, and has inclined bottoms on which the rake faces 53 are formed. The die elements 62 at the opposite ends of the die 60 are of different configurations from those of the other die elements but are also shaped to provide like cavities 70 for receiving therein the longitudinal brims 43 of the metal plate 40 respectively in order to forge the same in cooperation with the projections 82 of the punch 80, as shown in FIG. 9, to give like cutting edges also to the brims 43.

Figure 9C:
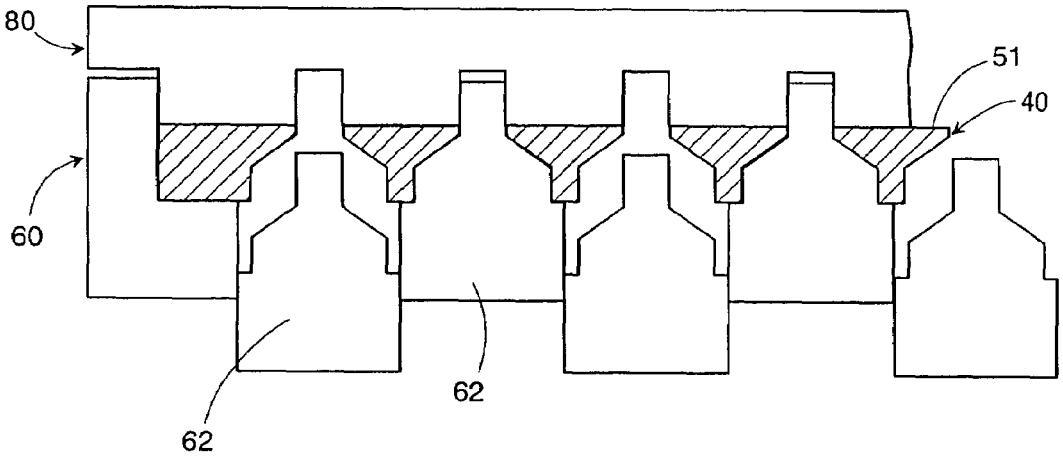

As shown in FIG. 8, disposed outwardly of the sliders 68 are actuators 90 each having a slanting face 91 for abutment with a like slanting face 69 of each slider 68. When the forging the metal plate 40, the actuators 90 are shifted vertically in one direction so as to engage the slanting faces 91 and 69, thereby bringing the die elements 62 into the tight packed condition. Before and after forging the metal plate 40, the actuators 90 are shifted vertically in the other direction so as to disengage the slanting faces 91 and 69, allowing the die elements 62 to move in the loosely packed condition. After forging the metal plate 40, i.e., the segments 51, as shown in FIG. 9B, the group of the predetermined die elements, for example, every alternate die elements 62 are removed from the metal plate 40, as shown in FIG. 9C, followed by the rest of the die elements 62 and the punch 80 are removed from the metal plate 40, releasing the metal plate 40 from the die 60 and the punch 80. With this scheme of removing some die elements 62 first from the just forged metal plate and then removing the rest of the die elements adjacent to the already removed die elements 62, it is possible to reduce a stress acting on the forged segments 51 when separating the metal plate from the die 60, thereby keeping the segments intact from undesired deformation and therefore realizing accurately and uniformly shaped segments 51, i.e., the blades of the inner cutter.

Figure 11A:
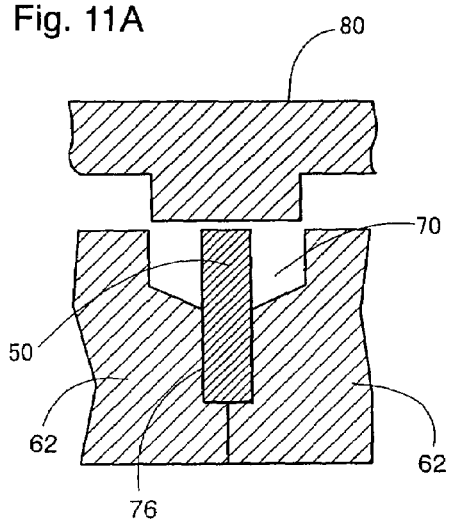
FIGS. 11A and 11B are sectional views illustrating another example of forging the metal plate.
Figure 11B:
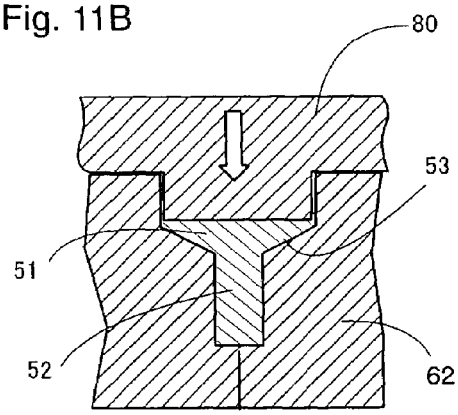

In the above illustrated embodiment, the beams 50 are dimensioned to have the width substantially equal to the width of the top space 72 of the cavity 70, i.e., to be fitted within the top space 72 between the adjacent die elements. However, it is equally possible, as shown in FIGS. 11A and 11B, to provide the beams 50 of which width is substantially equal to the width of the bottom space 76 and of which height is substantially equal to a total depth of the cavity 70 such that the segment of each beams is squeezed into the intended configuration having the rib 52 and the rake faces 53 projecting sideward from the top of the rib 52.

The hardening coat 48 is applied as a composite layer composed of a nickel layer deposited directly on the metal plate and a titanium layer on the nickel layer. After forging the segments, these layers are heat-treated to diffuse the nickel atoms and the titanium atoms to give a Ni—Ti intermetallic compound which is responsible for hardening the coat 48, thereby maintaining a sharp cutting performance over a prolonged life of use. The hardening coat 48 may be additionally formed on top of the metal plate to define the relief faces 55 thereby.

It is noted that the joint may be formed as an integral part of the metal plate, instead of being formed separately from the metal plate.

Figure 12:
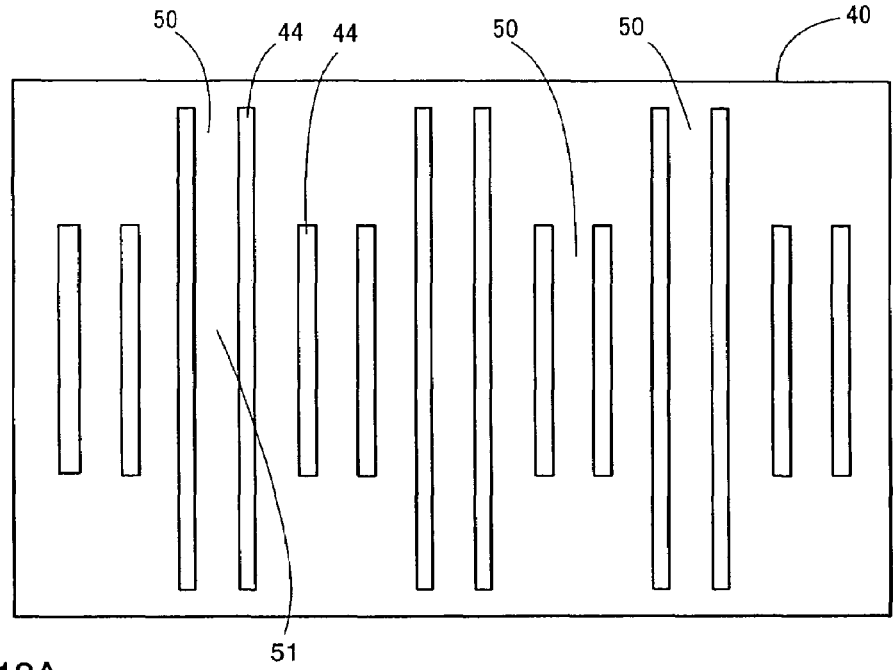
FIG. 12 is a plane view of a metal plate from which the inner cutter is fabricated in accordance with another embodiment of the present invention.
Figure 13A:
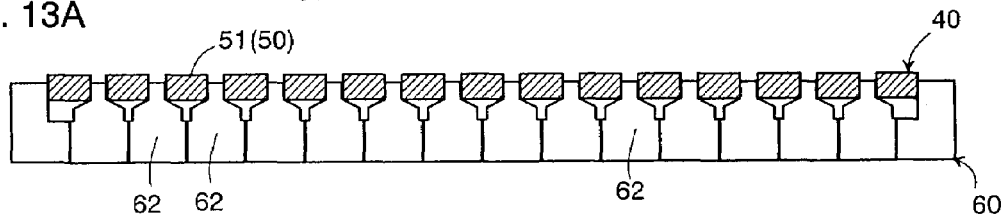
FIGS. 13A to 13D are sectional views illustrating the steps of forging the metal plate of FIG. 12.
Figure 13B:
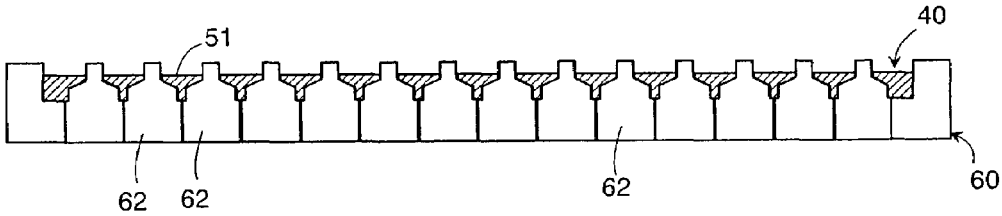
Figure 13C:
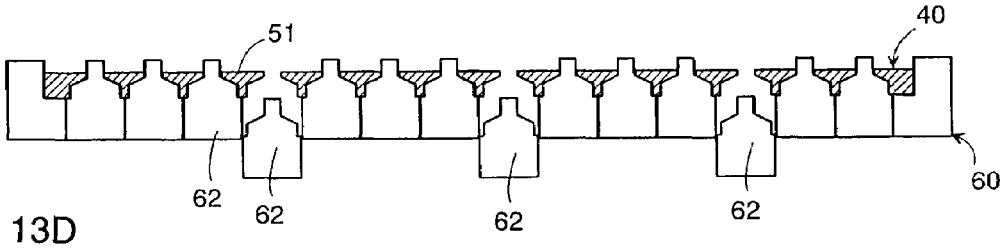
Figure 13D:
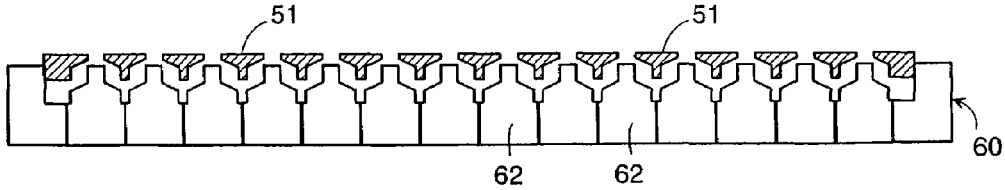

FIGS. 12 to 13 illustrate another embodiment of the present invention in which some of the beams 50, i.e., the corresponding slits 44 are made longer than the rest of the beams and the slits. In this embodiment, pairs of long beams 50 alternate pair of short beams. The long beams 50 are included in the beam array in order to generate an audible sound, when shaving the hairs, at a frequency reminding the user of a comfortable shaving being made. The segments 51 of the metal plate 40 are forged in the same manner as in the previous embodiment, as shown in FIGS. 13A and 13B, with all of the die elements 62 are held in the tightly packed condition. After forging the segments 51, one of the two adjacent die elements 62 for the long beam in each pair is firstly removed from the metal plate 40, as shown in FIG. 13C, and subsequently the rest of the die elements 62 are removed from the metal plate 40. Thus, the long beams 50, which is more susceptible to a stress developed when releasing the forged segments from the die than the short beams, can be kept intact from undesired deformation for uniform of the blades with accurately forged cutting edges. It is noted here that the length of the segments 51 provided with the cutting edges are the same for the long beams and the short beams.

Figure 14:
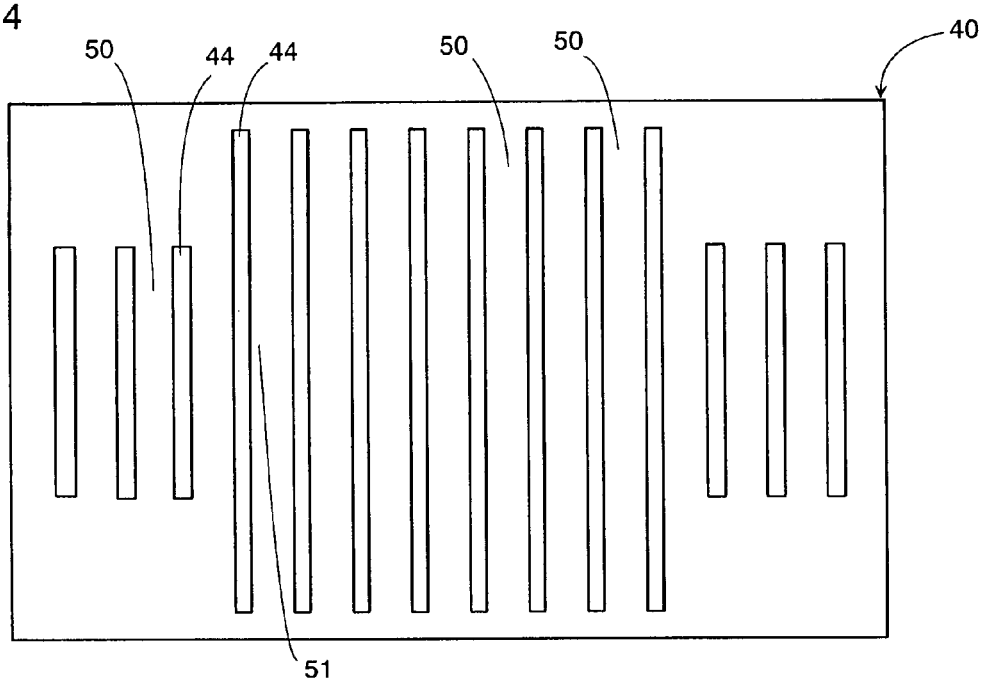
FIG. 14 is a plane view of a metal plate from which the inner cutter is fabricated in accordance with a further another embodiment of the present invention.
Figure 15A:
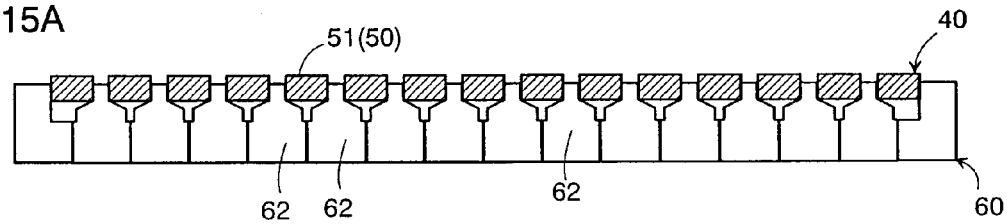
FIGS. 15A to 15D are sectional views illustrating the steps of forging the metal plate of FIG. 14.
Figure 15B:
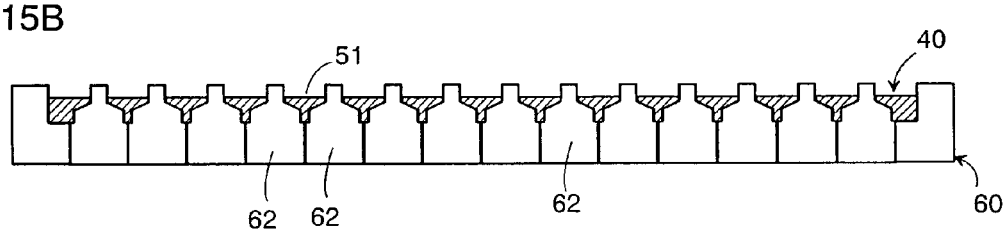
Figure 15C:
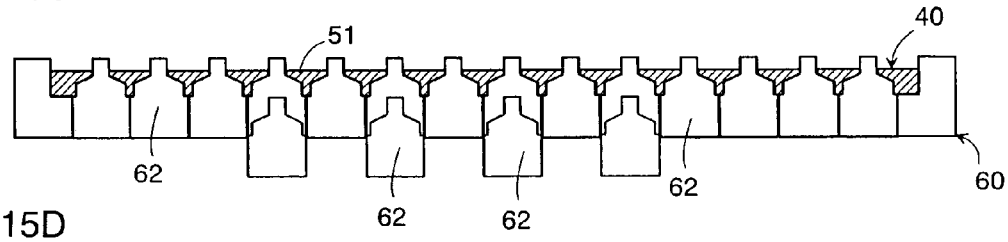
Figure 15D:
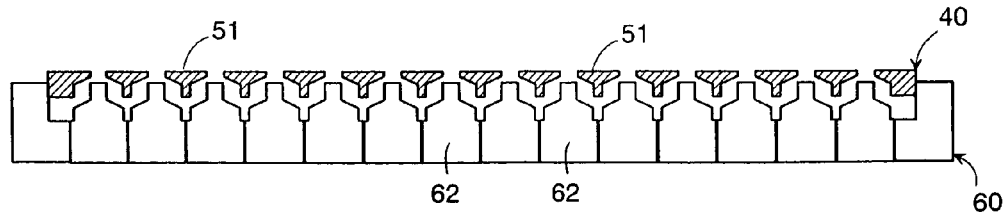

FIGS. 14 and 15 illustrate a further embodiment of the present invention in which more than two long beams 50 are successively formed in the middle of the beam array. In this embodiment, every alternate ones of the die elements 62 responsible for forging the long beams 50 are firstly removed from the metal plate after it is forged, as shown in FIG. 15C. Subsequently, all of the remaining die elements 62 including those responsible for the short beams are removed from the metal plate 40, as shown in FIG. 15D. The other steps and features of fabricating the inner cutter are identical to those explained in the above.

Although not illustrated in the figures, it is equally possible to bend the metal plate firstly into the U-shaped configuration and thereafter forge the segments of the bent beams with the use of correspondingly shaped die and the punch.

Figure 16A:
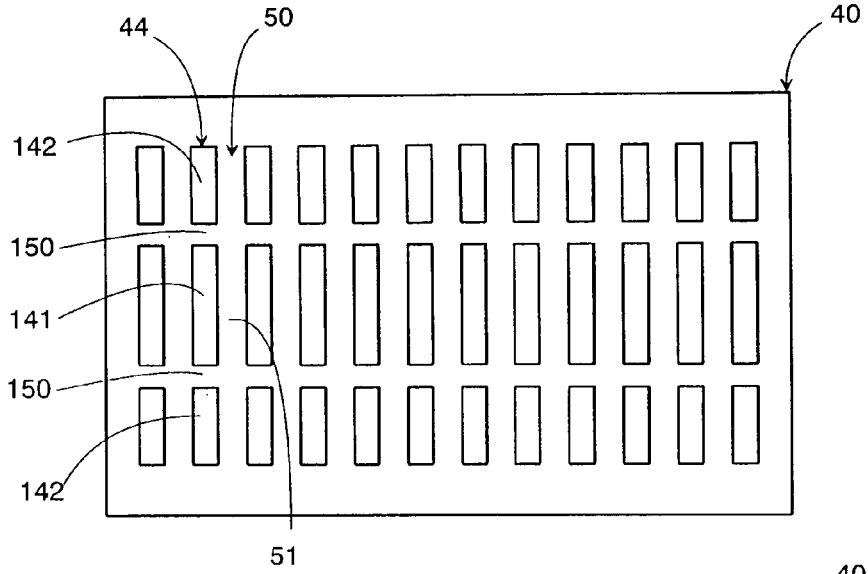
FIGS. 16A to 16D are views illustrating the steps of fabricating an inner cutter in accordance with a still further embodiment of the present invention.
Figure 16B:
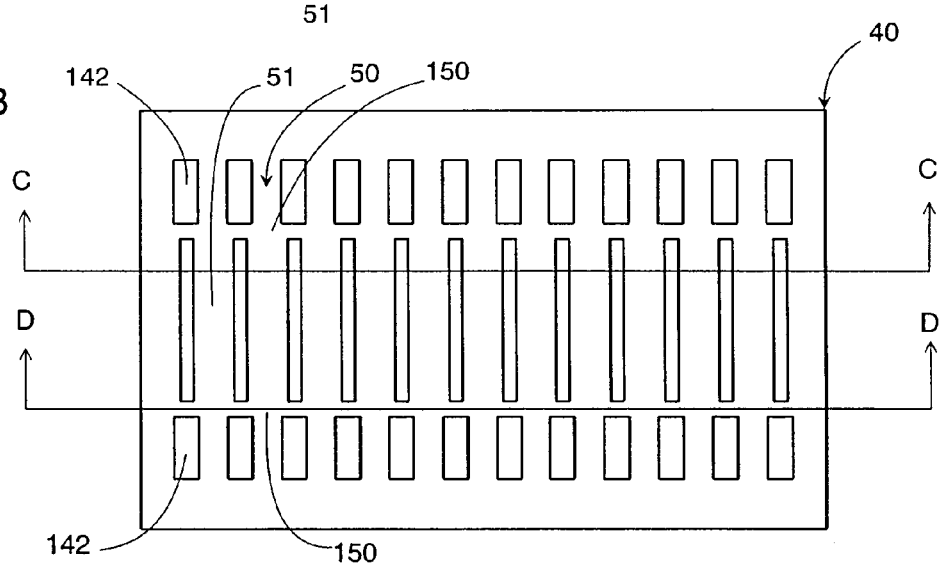
Figure 16C:
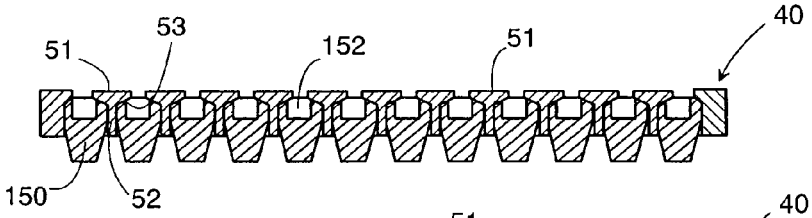
Figure 16D:
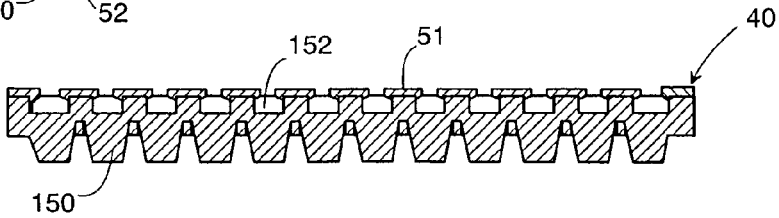
Figure 17A:
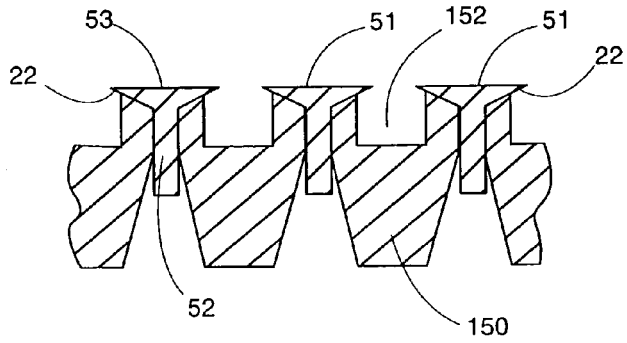
FIGS. 17A and 17B are partial sectional views of the inner cutter.
Figure 17B:
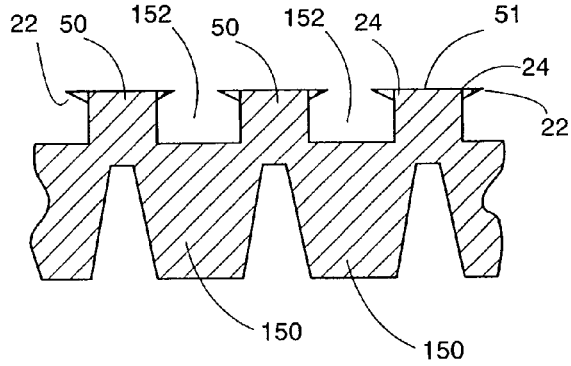

FIGS. 16A to 16D show steps of fabricating an inner cutter in accordance with a still further embodiment of the present invention. In this embodiment, the metal plate 40 is processed to have an array of slits 44 each divided into three sub-slits, i.e., a center sub-slit 141 and two end sub-slits 142 which are aligned along the width of the plate 40, as shown in FIG. 16A. These sub-slits 141 and 142 are spaced from each other by bridges 150 which are responsible for interconnecting adjacent beams 50 each defined between the two adjacent slits 44. A portion of each beam 50 formed between the center sub-slits 141 is defined as a segment 51 which is forged to have cutting edges in a like manner as in the previous embodiment. When forging the segments 51 to provide ribs 52 and rake faces 53, as shown in FIG. 16C which is a cross-section taken along line C—C of FIG. 16B, each bridge 150 is simultaneously deformed to have a recess 152 in its top, as best shown in FIG. 16D which is a cross-section taken along line D—D of FIG. 16B. After bending thus metal plate into a U-shaped configuration as is made in the previous embodiment, the metal plate 40 is polished to give a relief face 53 to each segment 51 for providing the cutting edges 22 on opposite of each segment 51, as well as to give a smooth top surface to each bridge 150, as shown in FIGS. 17A and 17B, which are cross-sections corresponding to line C—C and line D—D of FIG. 16B, respectively. The recess 152 is rectangular in cross-section, as best shown in FIG. 17B, and has opposed side walls 153 which intersect with the smooth top surface of the adjacent beams 50 not formed with the cutting edge 22 so as to define thereat auxiliary cutting edges 24. With this arrangement, the bridges 150 interconnect the adjacent beams 50 or the blades so as to reinforce the whole inner cutter, and at the same time give the auxiliary cutting edges for enhanced shaving efficiency.

What is claimed is:

1. A method of fabricating an inner cutter for a dry shaver, said inner cutter having a number of blades in shearing engagement with an outer cutter for cutting hairs, said method comprising:

providing a flat metal plate having a length and a width;

forming a plurality of parallel straight slits in said plate to leave an array of straight beams each defined between the adjacent ones of said straight slits, and to leave a frame around the array of said straight beams;

forging and grinding at least a segment of said beams to give cutting edges extending along said segment;

bending said metal plate into a generally U-shaped configuration so as to correspondingly curve said beams and shape said segments into said blades each having an arcuate contour and said cutting edges extending along said arcuate contour; and forming on said frame a joint for connection with a driving source of moving said inner cutter relative to said outer cutter, wherein said cutting edges of said segments are formed through:

placing said metal plate between a die and a punch;

forging said segments simultaneously by compacting the segments between said die and said punch to form on opposite undersurfaces of each segment rake faces oriented at an acute angle with respect to a top plane of said metal plate, leaving a bulge on top of said segment; and grinding said metal plate to remove said bulges in order to leave on top of each said segment a relief face which crosses with said rake faces at said acute angle to define therebetween said cutting edges.

2. The method as set forth in claim 1, wherein said metal plate has a thickness of at least 0.05 mm.

3. The method as set forth in claim 1, wherein each of said segments is deformed to have a rib projecting on the under surface of said segment, said rib being centered with respect to the width of said segment such that said rake faces extend sideward from the upper end of said rib.

4. The method as set forth in claim 1, wherein each of said slits is divided into at least two sub-slits arranged along the width of said plate and spaced by a bridge which is responsible for interconnecting said beams on opposite of each slit, each of said bridges being offset along the width of said metal plate from the segments of the adjacent beams formed with said cutting edges, and being deformed to develop a recess in top of said bridge such that said recess has opposed side walls which intersect with the top face of said beam not formed with said cutting edge to define thereat auxiliary cutting edges.

5. The method as set forth in claim 1, wherein said segments are hardened after being deformed and before being ground.

6. The method as set forth in claim 1, wherein said metal plate is covered with a hardening coat which becomes hardened by a treatment made after forging said segments.

7. The method as set forth in claim 6, wherein said hardening coat includes nickel and titanium.

8. The method as set forth in claim 6, wherein said hardening coat comprises a nickel layer on said plate and a titanium layer on said nickel layer, said layers being heat treated to diffuse the nickel and titanium atoms to give a Ni—Ti intermetallic compound therein.

9. The method as set forth in claim 8, wherein said hardening coat is provided at such a portion of said plate that are deformed to provide said rake faces.

10. The method as set forth in claim 1, wherein said plate is plastically deformed into said generally U-shaped configuration and simultaneously quenched.

11. The method as set forth in claim 1, wherein said die comprises a plurality of die elements which are detachably arranged with each other to provide a plurality of concaves for receiving said segments of the metal plate when forging them in cooperation with said punch projecting towards said concaves, at least one of said concaves being defined between the adjacent ones of said die elements, said method including steps of firstly removing a limited number of said die elements away from said metal plate after forging said segments, and subsequently removing the remainder of said die elements from the metal plate.

12. The method as set forth in claim 11, wherein said metal plate is processed such that at least one of said beams is formed as a long beam having a length longer than the adjacent beam, said method including steps of firstly removing away from said metal plate one of the two adjacent die elements between which the long beam is forged, and subsequently removing the other die element from the metal plate.

13. The method as set forth in claim 11, wherein said metal plate is processed such that a limited number of said beams are formed as an uninterrupted array of long beams each having a length longer than the remainder of said beams, said method including steps of firstly removing each one of the two adjacent die elements between which each of said long beams is forged for giving said cutting edge, and subsequently removing the other die element.

14. The method as set forth in claim 11, wherein said method utilizes a holder capable of selectively holding said die elements in a relatively loose engagement with each other and holding said die elements in a tight engagement with each other, said method including:

loosely holding said die elements with each other in said holder prior to placing said segments between said die and said punch;

tightly holding said die elements with each other in said holder while forging said segments of the beams;

loosening said die elements after forging said segments; and displacing at least one particular die element from the adjacent said die elements to remove said particular die element first from said metal plate.

15. The method as set forth in claim 14, wherein said holder comprises a frame retaining said die elements arranged side-by-side, and at least one slider attached to one end of said frame adjacent to an outermost one of said die elements, said at least one slider being movable relative to said frame between a release position where the slider gives only a retaining force of retaining said die elements in a lose engagement with each other and a lock position where the slider gives a constraining force of holding said die elements in a tight engagement with each other, said method including maintaining said slider in said release position, prior to forging said segments, so as to retain said die elements in said loose engagement with each other;

displacing said slider to said lock position, while forging said segments, so as to hold said die elements in said tight engagement with each other; and displacing said slider to said release position after forging said segments, eliminating said constraining force and allowing one or more of said die elements to be removed from said metal plate selectively.

16. The method as set forth in claim 11, wherein each said segment is deformed to have a rib projecting on the under surface of said segment, said rib being centered with respect to the width of said segment such that said rake faces extend sideward from the upper end of said rib, said at least one of said concaves formed between the two adjacent die elements including a top space having a rectangular cross-section with a first width corresponding to the width of said segment after being forged, a bottom space having a rectangular cross-section with a second width which is smaller than said first width and corresponds to a width of said rib, and an intermediate space having a tapered cross-section communicating said top space with said bottom space and having inclined bottoms on which said rake faces are formed, said metal plate being prepared to have the beams of which width is approximately equal to said first width.

17. The method as set forth in claim 11, wherein each said segment is deformed to have a rib projecting on the under surface of said segment, said rib being centered with respect to the width of said segment such that said rake faces extend sideward from the upper end of said rib, said at least one of said concaves formed between the two adjacent die elements including a top space having a rectangular cross-section with a first width corresponding to the width of said segment after being forged, a bottom space having a rectangular cross-section with a second width which is smaller than said first width and corresponds to a width of said rib, and an intermediate space having a tapered cross-section communicating said top space with said bottom space, and having inclined bottoms on which said rake faces are formed, said metal plate being prepared to give said beams of width is approximately equal to said second width and of which thickness is approximately equal to a total depth of said cavity measured from the top of said top space to the bottom of said bottom space.

18. A method of fabricating an inner cutter for a dry shaver, said inner cutter having a number of blades in shearing engagement with an outer cutter for cutting hairs, said method comprising:

providing a flat metal plate having a length and a width;

forming a plurality of parallel straight slits in said plate to leave an array of straight beams each defined between the adjacent ones of said straight slits, and to leave a frame around the array of said straight beams;

forging and grinding at least a segment of said beams to give cutting edges extending along said segment;

bending said metal plate into a generally U-shaped configuration so as to correspondingly curve said beams and shape said segments into said blades each having an arcuate contour and said cutting edges extending along said arcuate contour; and forming on said frame a joint for connection with a driving source of moving said inner cutter relative to said outer cutter, wherein said metal plate is bent into said generally U-shaped configuration prior to forming said cutting edges, and said cutting edges of each segment are formed through:

placing the U-shaped metal plate between a die and a punch;

forging said segments simultaneously by compacting the segments between said die and said punch to form on opposite undersurfaces of each segment rake faces oriented at an acute angle with respect to a top surface of said metal plate, allowing a formation of bulge on top of said segment; and grinding said metal plate to remove said bulges in order to leave on top of said segment a relief face which crosses with said rake faces at said acute angle to define therebetween said cutting edges.

19. The method as set forth in claim 18, wherein said metal plate has a thickness of at least 0.05 mm.

20. The method as set forth in claim 18, wherein each of said slits is divided into at least two sub-slits arranged along the width of said plate and spaced by a bridge which is responsible for interconnecting said beams on opposite of each slit, each of said bridges being offset along the width of said metal plate from the segments of the adjacent beams formed with said cutting edges, and being deformed to develop a recess in top of said bridge such that said recess has opposed side walls which intersect with the top face of said beam not formed with said cutting edge to define thereat auxiliary cutting edges.

21. The method as set forth in claim 18, wherein said plate is plastically deformed into said generally U-shaped configuration and simultaneously quenched.

* * * * *